United States Patent [19]

Kosaka et al.

[11] 3,978,647

[45] Sept. 7, 1976

[54] HIGHLY COHERENT AND RIGID SYNTHETIC MULTIFILAMENTARY YARN AND PROCESS FOR MANUFACTURING THE SAME

[75] Inventors: Kenzo Kosaka; Toshio Horikawa; Minoru Uchida; Shin Morioka; Kunio Shibata; Eizi Takahashi, all of Nagoya, Japan

[73] Assignee: Mitsubishi Rayon Co., Ltd., Tokyo, Japan

[22] Filed: Mar. 12, 1975

[21] Appl. No.: 557,453

Related U.S. Application Data

[63] Continuation-in-part of Ser. No. 315,554, Dec. 15, 1972, abandoned.

[30] Foreign Application Priority Data

Dec. 20, 1971 Japan ..... 46-102587
Dec. 21, 1971 Japan ..... 46-103231

[52] U.S. Cl. ..... 57/140 R; 57/157 TS
[51] Int. Cl.[2] ..... D02G 1/02; D02G 3/26

[58] Field of Search..... 57/36 AT, 140 R, 140 J, 57/157 TS

[56] References Cited

UNITED STATES PATENTS 3,058,291 10/1962 Heberlein et al..... 57/157 TS X
3,710,565 1/1973 Schnegg et al..... 57/157 TS X

*Primary Examiner*—Richard C. Queisser
*Assistant Examiner*—Charles Gorenstein
*Attorney, Agent, or Firm*—Armstrong, Nikaido & Wegner

[57] ABSTRACT

Highly coherent and rigid synthetic multifilamentary yarn of improved functional properties having a novel and unique configuration composed of multiple, retained, successive and alternate twist regions is manufactured by twisting thermoplastic fibers by a false-twisting means and at a high temperature selected with reference to the combined properties of the degree of the double refraction and the density of the material fiber.

10 Claims, 10 Drawing Figures

HIGHLY COHERENT AND RIGID SYNTHETIC MULTIFILAMENTARY YARN AND PROCESS FOR MANUFACTURING THE SAME

This is a continuation-in-part of an earlier application Ser. No. 315,554 filed on Dec. 15, 1972 and now abandoned.

The present invention relates to a highly coherent synthetic multifilamentary yarn and a process for the manufacture thereof. More particularly it relates to a polyester or the like multifilamentary yarn having a particular twist configuration and a false-twisting type process for the manufacture thereof at a most expedient processing temperature.

Woven or knitted fabrics made up of high twist yarns in general possess favourable feel to the hand, comfortable crispness, excellent air permeability, light weight and fashionable see-through property. These properties result from excellent coherency, high rigidity and strong untwisting torque characteristic to material yarns. In addition, thanks to their excellent drapability and crepe development, these fabrics are widely welcomed on the market in the form of various end items of wearing apparel. However, notwillstanding such meritorious features, such high twist yarns are in general very expensive owing to the low productivity of the manufacturing process.

Nevertheless there is an increasing consumer demand for products made up of high twist yarns, with the fashionable preference being for light weight and/or see-through properties. The market preference is also directed to an increasing variety of products with fabrics having soft feel to the hand, as well as an appearance and crispness characteristic of high twist yarn fabrics. In order to meet such trend in the market, there has been an increasing penetration of false twisted products into the conventional market area of high twist products. However, employment of the false-twisting technique inevitably results in an increase in the manufacturing cost of the products.

The background of the concept of the present invention is based on analytical observation of the differences in the twist configuration possessed by false twisted yarns while varying the processing temperature of the material yarns. When false twisting is carried out under the usual processing condition, that is at an ordinary temperature, the filamentary yarn obtained is in general provided with crimps and bulkiness. With escalation of the processing temperature, the filamentary yarn obtained starts to include retained twist regions developed locally along its length, the regions being interrupted by untwisted, crimped and bulked regions. The higher the processing temperature employed, the denser the distribution of the retained twist regions on the yarn obtained. By a precise observation of the yarn so obtained, it has been confirmed that the retained twist regions of the yarn have a yarn configuration almost similar to that inherent to high twist yarns and perfectly free from crimp development. Based on this it is clear that a multifilamentary yarn similar or eqiivalent in appearance and properties to high twist yarn can be easily obtained if such retained twist regions appear on the yarn without being interrupted by the untwisted, crimped and bulked regions. In order to attain such successive formation of the retained twist regions on the yarn by the false-twisting process, it is necessary to escalate the processing temperature up to the vicinity of the melting point of the synthetic polymer substance composing the material filaments. Such temperature escalation is conventionally accompanied with inevitable difficulty in the control operation, resulting in a lowering of the productivity of the process.

The basic object of the present invention is to provide a multifilamentary yarn having enhanced coherency, increased rigidity and high torque property.

Another object of the present invention is to provide a multifilamentary yarn which can be formed into fabrics having desirable feel to the hand, comfortable crispness, excellent air permeability, light weight and fashionable see-through property.

A further object of the present invention is to provide a novel process for manufacturing multifilamentary yarns of a nature similar to high twist yarns utilizing the falsetwisting technique.

A still further object of the present invention is to provide a process for manufacturing multifilamentary yarns of a nature similar to high twist yarn with high productivity, low cost and rare process troubles.

The synthetic multifilamentary yarn of the present invention is quite free of crimp development and is provided with multiple alternate S- and Z- twist regions retained successively along the yarn length. The yarn is obtained by a false-twisting type process at an extraordinary high temperature which is regulated in relation to the density and degree of the double refraction characteristic of the material thermoplastic synthetic filamants.

Further features and advantages of the present invention will be made clear from the ensuing description, reference being made to the accompanying drawings, in which.

Figure 1:
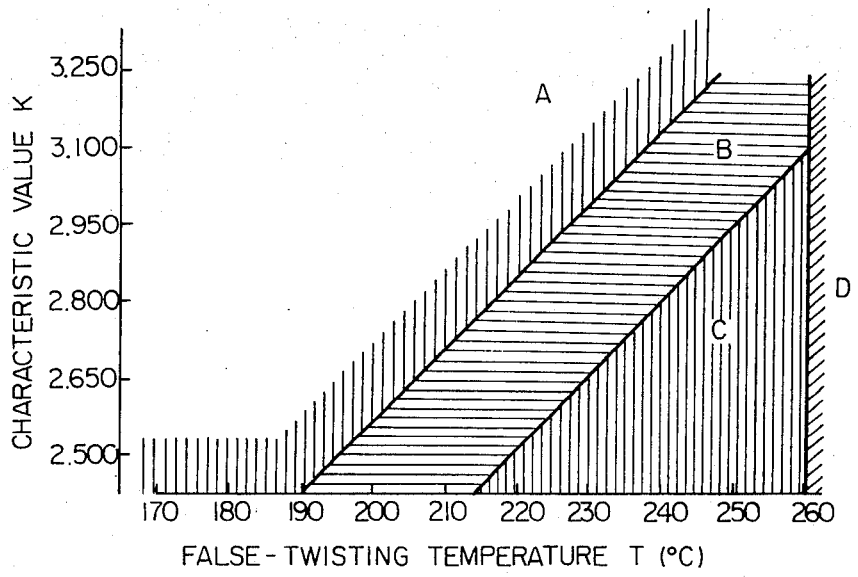
FIG. 1 is a graphical drawing showing a relationship between K value, indicating the characteristics of the material yarn, and the false-twisting temperature.

Referring to FIG. 1, there is graphically shown various configurations of yarns obtained by twisting, using a conventional false-twisting means, in relation to the properties of the material thermoplastic multifilamentary yarn and also to the temperature employed in the process. In the drawing, the characteristic value K representative of the combined properties of the material yarn is taken on the ordinate, and the processing temperature T in °C is taken on the abscissa. Under the processing conditon falling within the zone marked A, false-twisted yarns of an ordinary type are obtained. In the case of the zone marked B, the resultant yarns are partly crimped and partly twisted, i.e. some amount of twist is retained on the yarns. The zone C corresponds to the zone forming the alternate twist yarn of the present invention and, in zone D, no twisting can be carried out in a stable condition. The borderline between the zones B and C is represented by the following mathematicl equation:

$$K = 0.015T - 0.800$$

wherein I represents the processing temperature in °C. In this connection, the characteristic value $K$ of the material yarn is defined by the following equation:

$$K = \rho + 10\ \Delta n$$

In this equation, $\Delta n$ is the degree of the double refraction of the material yarn determined by a polarizing microscope measurement and $\rho$ is the density in g/cm$^3$ of the material yarn determined by the method using the density-gradient tube which is filled with two phases consisting of n-heptane and carbon tetrachloride.

Under the conditions that the above-mentioned relationships exist between K, T, $\rho$ and $\Delta n$, i.e. the conditions falling within the zone C shown in FIG. 1, the alternate twist yarn of the present invention is obtained by imparting twist to the material thermoplastic synthetic multifilamentary yarn. In other words, production of the yarn of the present invention can be advantageously achieved when the following relationships are satisfied:

$$\rho + 10\ \Delta n \leqq 0.015T - 0.800$$

and $$T \leqq 260$$

When the temperature is selected satisfying these relationships, the false-twisting type process of the present invention can yield alternate twist yarns of improved functional properties similar to those of high twist yarns. Though a processing temperature of relatively high degree is employed, the process of the present invention can be very smoothly carried out because the temperature is selected taking the physical properties of the material fibers into consideration, unlike the mere employment of high processing temperature in the conventional false twisting. Thus, as the process of the invention employs high temperature in the vicinity of the melting point of the fiber composing polymer, some of the component filaments of the obtained yarn are fused and adhered to each other in the form of a point or a line.

Figure 2:
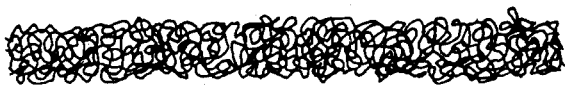
FIG. 2 shows an appearance of a typical yarn obtained under the process condition falling in the normal crimp yarn formation zone in FIG. 1.
Figure 3:
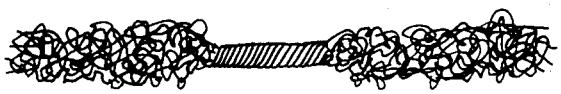
FIG. 3 shows an appearance of a typical yarn obtained under the process condition falling in the partly twisted crimp yarn formation zone in FIG. 1.
Figure 4:
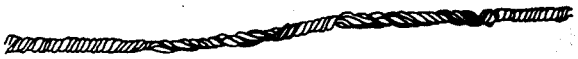
FIG. 4 shows an appearance of a typical yarn obtained according to the process condition falling in the alternate twist yarn formation zone in FIG. 1.

During the conventional false-twisting operation, the yarn is twisted by the twisting action of the false-twisting means, in the same direction as the false-twisting direction, upstream of the false-twisting means while the yarn is untwisted downstream of the false-twisting means. Thus, crimped yarns of a non-twisted appearance are obtained. However, in systematic study of false twisting at various temperatures using various material yarns having different K values obtained by spinning and drawing under various conditions, it was confirmed that with gradual escalation of the processing temperature, normal crimp yarns as shown in FIG. 2 were firstly obtained within the range of comparatively lower temperatures. Following escalation of the temperature, yarns including retained twist regions developed locally along their length, as shown in FIG. 3 were obtained. With a further escalation of the temperature, yarns with functional properties, similar to those of high twist yarns, comprising multiple alternate S- and Z- twist regions retained successively along their length, as shown in FIG. 4, were obtained. When the temperature exceeded this level, it became quite difficult to carry out the process due to yarn breakages or the like.

From our study, it was clear that the temperatures for developing the respective yarn configurations are dependent upon the magnitude of the characteristic value K of the material yarn to be processed. For example, in case the characteristic value K is large, only a normal crimp yarn as shown in FIG. 2 can be obtained even when a high processing temperature is employed, while allowing some extent of variation in dimension and stability of the crimp. On the other hand, in case the characteristic value K is rather small, partly twisted crimp yarn as shown in FIG. 3, or alternate twist yarn as shown in FIG. 4, can be obtained at low processing temperatures. However, the fabrics made up of such yarns obtained at such low temperatures may have uneven surfaces and may be accompanied by undesirable uneven dye-effect caused by lengthwise variation in the yarn configuration, although they have some crispness and air permeability.

Thus, the yarn of the present invention is composed of a single synthetic multifilamentary strand and is highly coherent and rigid. The yarn comprises multiple alternate S- and Z- twist regions retained successively along the yarn length, some of component filaments of the yarn being partially fused and adhered to each other and the extent of fusing and adhesion and the number of twists of each of the regions having twists of the same direction as the twisting direction being greater than those of the regions having twists of the opposite direction to the twisting direction. Due to the differences in the extent of fusing and adhesion and in the number of twists, the coherency of the regions having twists of the same direction as the twisting direction is higher than that of the regions having twists of the opposite direction to the twisting direction.

The theoretical ground for the formation of the abovementioned yarn configuration is not clear. However, it may be understood that in the conventional false twisting a high degree of crimp is imparted to the yarn when an escalated temperature is applied, but under the conditions, particularly at a temperature in the vicinity of the melting point of the yarn composing polymer, according to the invention, the yarn is highly softened and the component filaments of the yarn are fused and adhered to each other, in the twisting zone upstream of the false-twisting means, with the assistance of the contact bonding force due to the high degree of twist imparted by the false-twisting means. The fusing and adhesion between the component filaments occurs randomly along the lengthwise portions of the yarn because the yarn being processed is unevenly heated due to the vibration of the yarn on the surface of the heater, which vibration occurs by the ballooning of the yarn under the twisting action of the false-twisting means. When the yarn is advanced to the untwisting zone downstream of the false-twisting means, the twists of the comparatively strongly fused and adhered portions can not be satisfactorily untwisted by the untwisting action of the false-twisting means and, thus, the portions having twists of the same direction as the twisting direction are retained as they are not completely untwisted. On the other hand, in this untwisting zone, the portions which were not so strongly fused and adhered in the twisting zone are untwisted completely and further twisted in the direction opposite to the twisting direction. Some of these twists of the opposite direction are then retained in these portions and, thus, the yarn of the hereinbefore mentioned unique configuration is obtained.

The obtained yarn is highly coherent and rigid because of the fusing and adhesion between the component filaments and of the retained alternate twists. However, as the twists of the opposite direction are not so strongly set, the obtained yarn has a strong torque.

The formation of the alternate twists may be additionally promoted by the unevenness of fineness and/or thermal unevenness of the material yarn. This is because these unevennesses of the material yarn produce uneven distribution of twists in the twisting zone and the uneven distribution of twists produces uneven smoothness of the yarn at the time when the yarn is passed through the false-twisting means and, thereby, the yarn is occasionally passed through the false-twisting means without receiving its false-twisting action.

From the careful observation of the yarns of the present invention, in general, it was confirmed that the regions having twists of the same direction as the twisting direction had lengths of less than 4 milimeters while the regions having twists of the opposite direction to the twisting direction, i.e. of the same direction as the untwisting direction had lengths of less than 8 milimeters. Further, it was confirmed that the number of twists of each of the yarn regions having twists of the former direction was larger than those of the regions having twists of the latter opposite direction but less than the number of false twists imparted to the yarn.

The yarn of the present invention having a unique configuration composed of multiple, retained, successive and alternate twist regions, such as shown in FIG. 4, has no bulkiness but does have other functional properties very much like the high twist yarns. Therefore, fabrics made up of such yarns possess comfortable crispness and excellent air permeability. Fabric surfaces are well regulated and quite similar to those of high twist yarns and are free from any unevenness in dye-effect. In addition, when the yarns are incorporated in the fabric structure, presence of the alternate S- and Z- twist regions may yield crepe effect on the fabric structures upon treatment by boiling water due to the strong torque possessed by the component yarns.

When the characteristic value K of the material yarn is larger than 3.100, the configuration of the yarn obtained approaches that of the normal crimp yarn and is less like that of the alternate twist yarn. On the other hand, when the value K is too small, one can not expect a sufficient heat-setting effect. Consequently, the yarn obtained becomes unstable in its configuration retainability, and the properties of the yarn related to the configuration undesirably vary with time. In addition, a lowering of its thermal stability is realized also.

Basically, this invention utilizes the apparent depression of the melting point of the material thermoplastic synthetic polymer by regulating the characteristics of the same in the already explained sense.

The apparent melting points of thermoplastic synthetic multifilamentary yarns, especially of polyester multifilamentary yarns, vary in accordance with the difference in the spinning or drawing conditions even when polymers of the same type are used as the starting materials. Therefore, if yarns composed of the same material polymer are spun or drawn under different processing conditions from each other, crimp properties of the yarns obtained differ from each other even if a similar false-twisting temperature is employed. When the optical degree of the orientation or the degree of the double refraction of the yarn is unchanged, i.e. the orientation of the molecular chains of the component polymer is unchanged, the apparent melting point of the yarn obtained varies depending on the density or the degree of the crystallinity of the component polymer. On the other hand, when the density of the polymer is unchanged, the orientation of the molecular chains of the component polymer can not be defined. For these reasons, regulation of the characteristics of the material yarn necessitates regulation of both the degree of the double refraction and the density of the polymer in combination.

From this point of view, the above-mentioned characteristic value K of the yarn is represented by the following mathematical equation:

$$K = \rho + 10\,\Delta n$$

Here, $\Delta n$ represents the degree of the double refraction and $\rho$ the density in g/cm$^3$. By defining K in this manner, both variables, i.e. $\rho$ and $\Delta n$, are expected to influence the value K to a similar extent.

The material yarns usable for the present invention may include yarns of any synthetic thermoplastic polymer fibers, but polyester fibers are preferred. The term "polyester" used herein refers to a homopolymer of ethylene terephthalate, a copolymer containing at least 75% of ethylene terephthalate unit or a polymer blend containing at least 75% of polyethylene terephthalate. The material yarns having the characteristic value K within the range according to the present invention can be obtained by drawing undrawn yarns at a comparatively low drawing ratio previous to or concurrently with the process of the invention, or by treatment capable of imparting high shrinkability to such yarns. Thus, so called partially oriented yarns, such as those obtained by high speed spinning of a polymer, may also be employed as the material yarns. Particularly in the case of polyester, it is preferred to employ yarns composed of filaments having a $\Delta n$ of not less than $30 \times 10^{-3}$ and a $\rho$ of not less than 1.348 while applying no drawing or to employ yarns composed of filaments having a $\Delta n$ of less than $30 \times 10^{-3}$ and a $\rho$ of less than 1.348 while applying the drawing with a drawing ratio of not less than 1.2.

In the false-twisting type process according to the present invention, yarns preliminarily twisted in a direction the same as the twisting direction may be used. This preliminary twisting allows residual twists to be retained on the obtained yarn. Presence of such retained preliminary twists assures increased coherency of the yarn and, in addition, makes it easier to obtain the alternate twist yarn. In order to make such residual twists contribute to the increases in the yarn coherency, and in the productivity of the process by such preliminary twisting, it is advantageous to false twist the yarn in the direction the same as the preliminary twisting direction. There is no particular limitation to the number of these preliminary twists. However, so that the yarn can be placed under the processing temperature for a long period, thereby facilitating the development of the alternate twist configuration, it is not preferable to employ a number approximating the twisting number. Based on experimental results, it is desirable to preliminarily twist the yarn with a number of twists one half of the twisting number or smaller.

Figure 5A:
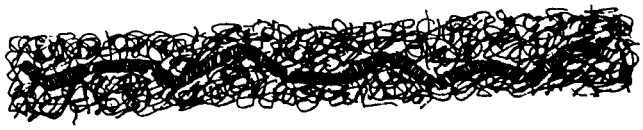
FIGS. 5A to 5C show appearances of yarns obtained by consolidating or doubling the alternate twist yarn with a normal crimp yarn.
Figure 5B:
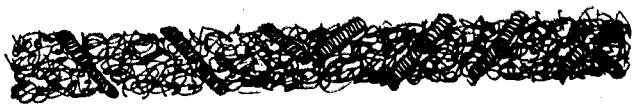
Figure 5C:
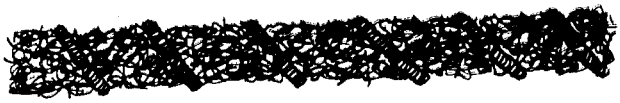

Also, in a modified embodiment of the present invention, a strand, whose characteristics are regulated in the already explained sense, may be processed together with a strand not regulated. Such strands may be processed all together after preliminary twisting. The yarn obtained has a two folded unique crimp configuration as shown in FIGS. 5A, 5B or 5C. In this configuration, both types of strands are intertwined to each other. At locations along the length of the yarn, S- and Z-alternate twist portions of the component strand are provided. In another example of this embodiment, a crimp strand and a strand having alternate twists are twisted together forming one body.

These yarns possess strong torque and high rigidity, like high twist yarns, as well as the properties of crimp yarns. Consequently, fabrics made up of such yarns can possess meritorious properties of high twist yarns and of crimp yarns together in combination. Crispness of high twist yarns and porous yarns, as well as soft feel and warmth characteristic to crimp yarns are obtained together.

In order to obtain yarns of this type from the filamentary strands of the same material polymer, the false-twisting should be carried out at the same temperature using strands having characteristics falling within two different zones; A and B or B and C in FIG. 1. Also, in case different material strands are used, it is necessary to use strands having melting points higher than the falsetwisting temperature according to the present invention. In this way, the above-described yarns having unique crimp configurations can be obtained in accordance with the process of the present invention.

The following examples are illustrative, but not limitative, of the present invention. In the examples, "overfeed percentage in the first feed" refers to $$\frac{\left(\begin{matrix}\text{surface speed of}\\ \text{feed roller}\end{matrix}\right) - \left(\begin{matrix}\text{surface speed of}\\ \text{delivery roller}\end{matrix}\right)}{\left(\begin{matrix}\text{surface speed of}\\ \text{delivery roller}\end{matrix}\right)} \times 100$$

and "overfeed percentage in the second feed" refers to $$\frac{\left(\begin{matrix}\text{surface speed of}\\ \text{delivery roller}\end{matrix}\right) - \left(\begin{matrix}\text{surface speed of}\\ \text{take-up roller}\end{matrix}\right)}{\left(\begin{matrix}\text{surface speed of}\\ \text{take-up roller}\end{matrix}\right)} \times 100.$$

EXAMPLE 1

Polyester undrawn filaments spun at a rate of 1700 m/min were drawn at a processing rate of 800 m/min, a drawing roll temperature of 80°C and a draw ratio of 2.311. The obtained multifilament semi-dull yarn of 50 denier and a substantially round cross section was composed of 24 filaments. The yarn had the property of $\Delta n \times 10^3$ of 133 and $\rho$ of 1.354. The yarn was then false twisted under the following conditions.

1. False-twister: ST-6*
2. Rotation of spindle (rpm): 300,000
3. Number of twist (turn/meter): 4,100
4. Temperature of heater (°C): 235
5. Overfeed percentage in the first feed: +3
6. Overfeed percentage in the second feed: +5

* Spindles per machine of 188, denier range of 30 to 200, single heater of 900 mm length, upper limit of spindle rotation of 400,000 (rpm), upper limit of processing yarn speed of 120 m/min, manufactured by Mitsubishi Heavy Industries, Ltd., Japan.

The resultant yarn had no crimped portions but alternate S- and Z-twist regions which were retained without being untwisted. The yarn had a rigidity characterized by its strong torque and its appearance was quite similar to that of high twist yarns.

EXAMPLE 2

Polyester undrawn filaments spun at a rate of 1700 m/min were drawn at a drawing roll temperature of 75°C and a draw ratio of 2.437. The obtained multifilament semi-dull yarn of 75 denier and a substantially round cross section was composed of 36 filaments. The yarn had the property of $\Delta n \times 10^3$ of 149 and $\rho$ of 1.358. Then the yarn was false twisted under the following conditions.

1. False-twister: ST-6
2. Rotation of spindle (rpm): 280,000
3. Number of twist (turn/meter): 3,500, Z-direction
4. Temperature of heater (°C): 243
5. Overfeed percentage in the first feed: +3
6. Overfeed percentage in the second feed: +5

The resultant yarn had no crimped portions but retained alternate twist regions, like the yarn obtained in Example 1. The yarn had a rigidity characterized by its strong torque and its appearance was quite similar to that of high twist yarns.

Figure 6:
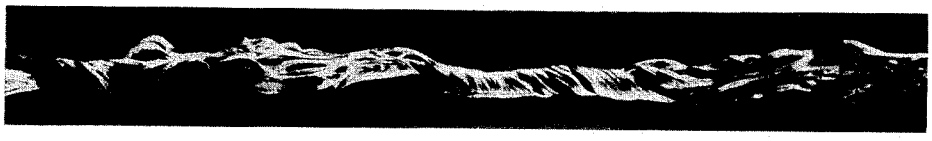
FIG. 6 is a microscopically enlarged photograph of a yarn of the present invention.
Figure 7A:
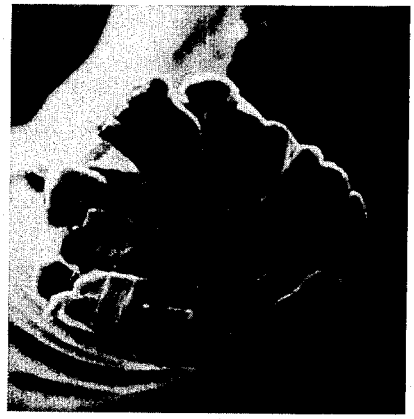
FIGS. 7A and 7B are microscopically enlarged photographs of the transverse cross sections of the yarn shown in FIG. 6.
Figure 7B:
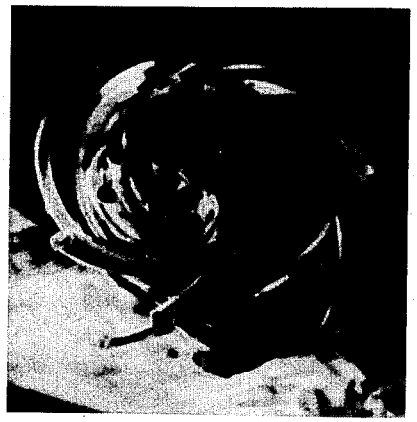

A microphotograph of 55 magnification of the obtained yarn is shown in FIG. 6. Also, microphotographs of the transverse cross sections of this yarn are shown in FIGS. 7A and 7B, in which FIG. 7A shows at 300 magnifications the cross section of the region having Z-twist and FIG. 7B shows at 150 magnifications the cross section of the region having S-twist. From these photographs a unique configuration of the yarn of the present invention is clearly seen.

EXAMPLE 3

A drawn multifilament yarn, as prepared in Example 2, was preliminarily twisted at a number of twists of 1,000 turns/meter in the Z-direction, the same as the false-twisting direction, which is about one third the number in the false twisting. The yarn was then false twisted under the following conditions.

1. False-twister: ST-6
2. Rotation of spindle (rpm): 275,000
3. Number of twist (turn/meter): 3,200, Z-direction
4. Temperature of heater (°C): 245
5. Overfeed percentage in the first feed: +3
6. Overfeed percentage in the second feed: +5

The resultant yarn had no crimped portions but retained alternate twist regions, the preliminary twists fully remained and the coherency of the yarn was increased. The yarn had a strong torque and high rigidity and was quite similar to high twist yarns.

EXAMPLE 4

Polyester undrawn filaments, spun at a rate of 1700 m/min. were drawn at a processing rate of 800 m/min, a drawing roll temperature of 80°C and a draw ratio of 2.311. The obtained multifilament semi-dull yarn of 50 denier and a substantially round cross section was composed of 24 filaments. The yarn had the property of $\Delta n \times 10^3$ of 133 and $\rho$ of 1.354.

Polyester undrawn filaments spun at the same rate as described above, except for the difference in extrusion output from the spinning nozzle, were drawn at a processing rate of 800 m/min, a drawing roll temperature of 90°C and a draw ratio of 2.589. The obtained multifilament semi-dull yarn of 50 denier and a substantially round cross section was composed of 24 filaments. The yarn had the property of $\Delta n \times 10^3$ of 169 and $\rho$ of 1.374.

The above two yarns were doubled and then false twisted under the following conditions.

1. False-twister: ST-6
2. Rotation of spindle (rpm): 330,000
3. Number of twist (turn/meter): 3,000
4. Temperature of heater (°C): 240
5. Overfeed percentage in the first feed: +2
6. Overfeed percentage in the second feed: +5

The yarn thus obtained was two folded and had a unique crimp configuration. In this configuration, a crimp strand and a strand having retained alternate twists but no crimped portions are intertwined with each other along their length as shown in FIG. 5A and, at locations along the length of the yarn, S- and Z-alternate twist portions of the component strands such as shown in FIG. 5B are provided.

EXAMPLE 5

Two of the yarns as prepared in Example 4 were doubled and preliminarily twisted in a direction the same as the false-twisting direction at a number of twists of 700 turns/m in order to increase the coherency of the component strands to be obtained after the false twisting. The obtained yarn was false twisted under the following conditions.

1. False-twister: ST-6
2. Rotation of spindle (rpm): 300,000
3. Number of twist (turn/meter): 2,500, Z-direction
4. Temperature of heater (°C): 241
5. Overfeed percentage in the first feed: +3
6. Overfeed percentage in the second feed: +5

The yarn obtained was two folded and had a unique crimp configuration. In this configuration, a crimp strand and a strand having retained alternate twists but no crimped portions are twisted together along their length in a direction the same as the preliminary twisting direction as shown in FIG. 5C.

EXAMPLE 6

A drawn polyester multifilament yarn of 50 denier composed of 24 filaments, as prepared in Example 1, and a triacetate multifilament semi-dull yarn of 55 denier composed of 24 filaments and having a softening point of 250°C were doubled and then preliminarily twisted in the Z direction at a number of twists of 600 turns/meter. The softening point of the triacetate yarn was higher than the subsequent false-twisting temperature which was to be determined from the characteristics of the above polyester yarn. The twisted yarn was then false twisted under the conditions described in Example 5.

The resultant yarn was two folded and had a unique crimp configuration. In the configuration, a triacetate crimp strand and a polyester strand having retained alternate twists but no crimped portions are twisted together along their length as shown in FIG. 5C.

EXAMPLE 7

A partially oriented polyester multifilamentary semi-dull yarn of 90 deniers/36 filaments was false twisted under the following conditions. This yarn was obtained by spinning polyester melt into filaments with a substantially round cross section at a rate of 3,500 m/min and the yarn had the property of $\Delta n \times 10^3$ of 50 and $\rho$ of 1.348.

1. False-twister: ST-6
2. Rotation of spindle (rpm): 300,000
3. Number of twist (turn/meter): 3,000, Z-direction
4. Temperature of heater (°C): 243
5. Overfeed percentage in the first feed: −15
6. Overfeed percentage in the second feed: +5

The resultant yarn had no crimped portion but retained alternate twist regions, like the yarn obtained in Example 2.

EXAMPLE 8

A polyester undrawn semi-dull yarn of 195 deniers/36 filaments was obtained by spinning polyester melt into filaments with a substantially round cross section at a rate of 1,600 m/min. The yarn had the property of $\Delta n \times 10^3$ of 18 and $\rho$ of 1.347. This yarn was then false twisted, while being drawn, under the following conditions.

1. False-twister: ST-6*
2. Rotation of spindle (rpm): 300,000
3. Number of twist (turn/meter): 3,000, Z-direction
4. Temperature of heater (°C): 243
5. Draw ratio: 2.61 **
6. Overfeed percentage in the second feed: +5

* The apparatus was modified to make concurrent drawing possible.
** Draw ratio refers to the ratio of the surface speed of the delivery roller to the surface speed of the feed roller.

The resultant yarn had a unique configuration similar to that of the yarn obtained in Example 2.

What we claim is:

1. Highly coherent and rigid synthetic multifilamentary yarn of improved functional properties, composed of a single multifilamentary strand, comprising multiple alternate S- and Z-twist regions of irregular lengths formed by false twisting and retained successively along the yarn length, some of the component filaments of said yarn being partially fused and adhered to each other and the extent of fusing and adhesion and the number of twists of each of the regions having twists of the same direction as the twisting direction being greater than those of the regions having twists of the opposite direction to said twisting direction.

2. Highly coherent and rigid synthetic multifilamentary yarn as claimed in claim 1, wherein said yarn consists of polyester fiber.

3. Highly coherent and rigid synthetic multifilamentary yarn as claimed in claim 1, wherein said regions having twists of the same direction as the twisting direction have lengths of less than 4 milimeters while said regions having twists of the opposite direction to said twisting direction have lengths of less than 8 milimeters.

4. Highly coherent and rigid synthetic multifilamentary yarn as claimed in claim 1, wherein the number of twists of each of said regions having twists of the same direction as the twisting direction is less than the number of false twists imparted to the yarn.

5. Highly coherent and rigid synthetic multifilamentary yarn as claimed in claim 1, wherein said alternate twist regions are formed by false twisting a multifilamentary strand and concurrentry heating the same at a temperature defined in °C by the equation:

$$\rho + 10\,\Delta n \leqq 0.015\,T - 0.800$$

and $$T \leqq 260$$

wherein $\rho$ is density of the material in g/cm$^3$ and $\Delta n$ is degree of double refraction of said material filament.

6. A process for manufacturing a synthetic multifilamentary yarn having multiple alternate S- and Z- twist regions retained successively along the yarn length, which process comprises 1. supplying the multifilament yarn to a false-twisting apparatus,
2. passing the yarn through a heating zone having a temperature defined in °C by the equation:

$$\rho + 10\,\Delta n \leqq 0.015\,T - 0.800$$

and $$T \leqq 260$$

wherein $\rho$ is density of the material in g/cm$^3$ and $\Delta n$ is degree of double refraction of said material filament, the individual filaments of the yarn being softened and partially melted such that regions are formed wherein the filaments are intermitently fused and adhered to each other in a twisting direction, 3. passing the yarn in a-heated condition through the false-twisting apparatus, whereby regions are formed after passing through the apparatus wherein the individual filaments are substantially unfused and are twisted in a direction opposite to the twisting direction, and
4. recovering the resulting yarn.

7. The process as claimed in claim 6, wherein said material filament consists of polyester.

8. The process as claimed in claim 6, further comprising concurrentry drawing said material strand while it is being twisted.

9. The process as claimed in claim 6, further comprising preliminary twisting of said material strand in a direction the same as said twisting direction.

10. The process as claimed in claim 9, wherein the number of said preliminary twists is one half or less of said twisting number.

* * * * *